US005320189A

United States Patent [19]

Rodert et al.

[11] Patent Number: 5,320,189

[45] Date of Patent: Jun. 14, 1994

[54] ROCK DRILLING DEVICE

[75] Inventors: Jörgen Rodert, Saltsjö-Boo; Kurt Andersson, Tyresö, both of Sweden

[73] Assignee: Atlas Copco Rocktech AB, Nacka, Sweden

[21] Appl. No.: 40,863

[22] Filed: Mar. 31, 1993

[30] Foreign Application Priority Data

Apr. 9, 1992 [SE] Sweden ..... 9201143

[51] Int. Cl.[5] ..... E21B 17/00

[52] U.S. Cl. ..... 175/296; 175/135

[58] Field of Search ..... 175/293, 296, 135

[56] References Cited

U.S. PATENT DOCUMENTS

| | | | |
|---|---|---|---|
| 3,154,158 | 10/1964 | Lincoln | 175/135 |
| 3,552,500 | 1/1968 | Peterson | 175/296 X |
| 3,977,480 | 8/1976 | Hilding | 175/135 X |
| 4,387,775 | 6/1983 | Adolfsson et al. | 175/135 |
| 5,085,284 | 2/1992 | Fu | 175/296 |

*Primary Examiner*—Thuy M. Bui

*Attorney, Agent, or Firm*—Mark P. Stone

[57] ABSTRACT

Rock drilling device comprising a backhammer unit (10) in which a hammer piston (9) is movable to-and-fro for automatically exposing a tube string (4) to impacts in a direction away from a drill bit (8) in the tube string. The backhammer unit comprises a housing (13) and a springloaded tube part (14). The housing and the tube part form between them a first valve (16) and a second valve (17). At drilling the first valve which controls the supply of driving medium to said hammer piston is closed and the second valve which controls the flushing medium flow is open. At backwards feeding of the rock drilling machine (2) along the feed beam (1) with a force which exceeds a predetermined value the first valve is open and the second valve is closed.

3 Claims, 2 Drawing Sheets

ROCK DRILLING DEVICE

The present invention relates to a rock drilling device. More particularly the invention relates to a backhammer for a rock drilling device.

In a prior art device of the above mentioned kind, see DE 3802391, a hammer device is used which is inserted into the tube string when needed so that the tube string is exposed to impacts in a direction away from the drill bit. A drawback with this device is that one has to disconnect the drilling machine from the tube string when the drill tool jams and insert a special unit which at normal drilling has to be stored in a suitable place to be at hand when the backhammer is needed.

The present invention, which is defined in the subsequent claims, aims at achieving a backhammer which during drilling is at hand and which automatically becomes operative when a need for the backhammer arises.

Figure 1:
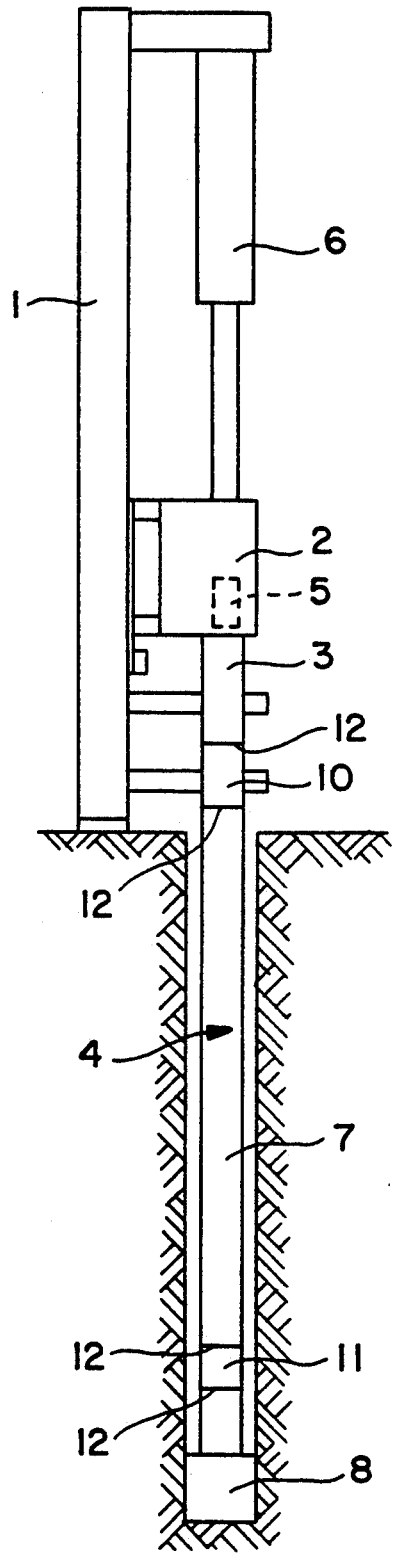

An embodiment of the invention is described below with reference to the accompanying drawings in which FIG. 1 schematically shows a rock drilling device according to the invention.

Figure 2:
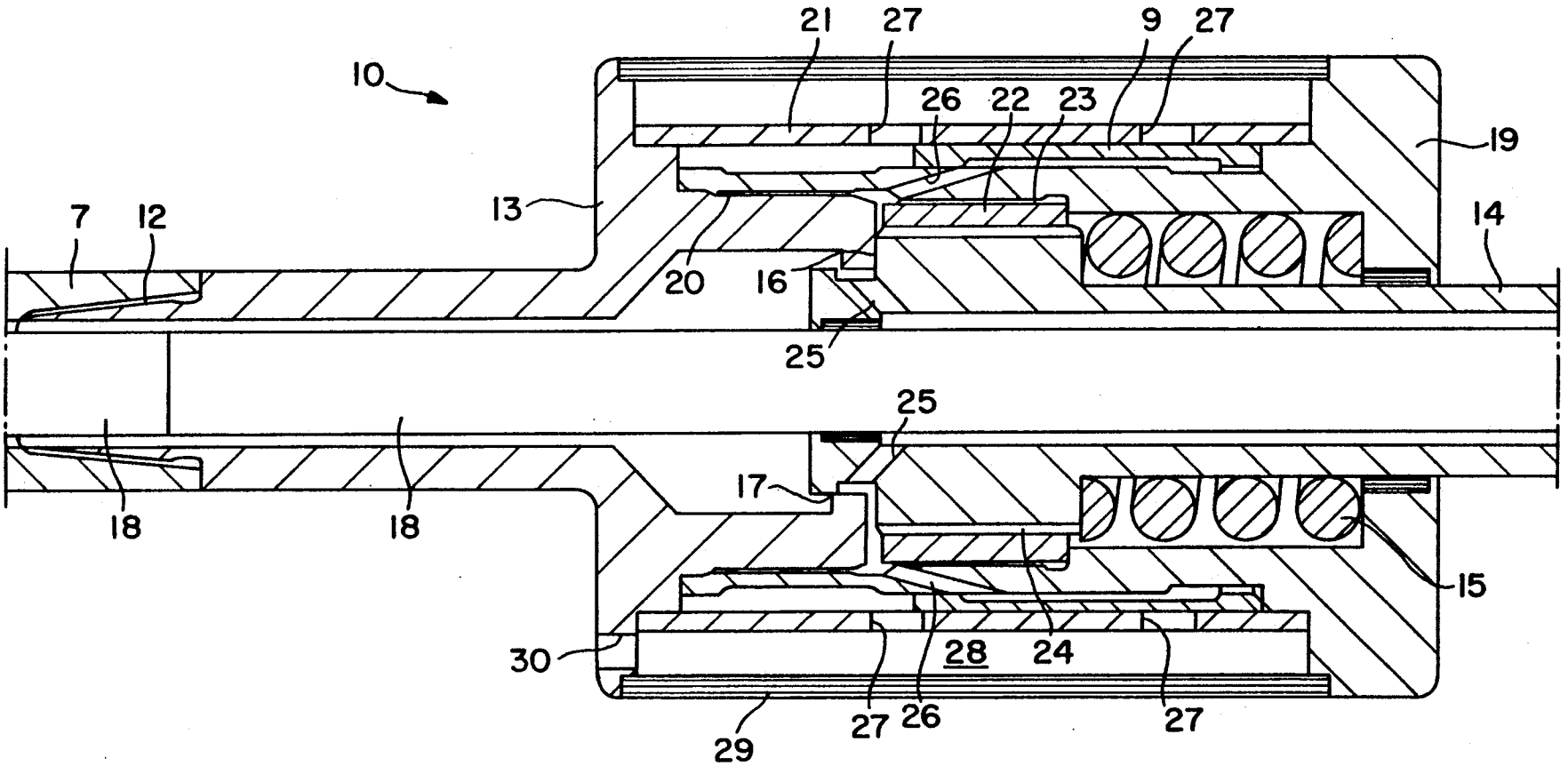

FIG. 2 shows in section a backhammer unit forming part of the rock drilling device according to FIG. 1.

The rock drilling device shown in the drawings comprises a feed beam 1 which is carried by a not shown carrier. A rock drilling machine 2 is movable to-and-fro along the feed beam 1 by means of a feeding device 6. The shown rock drilling machine is meant for top hammer drilling and comprises, therefore, a first hammer piston 5 being movable to-and-fro for impacting a drill bit 8 via a drilling tool 4. The invention can also be used together with down-the-hole drilling machines. In that case the hammer piston is positioned adjacent to the drill bit and the rock drilling machine comprises a rotary motor. The shown rock drilling machine comprises a shank adapter 3 to which a tube string 4 is connected. The tube string comprises a backhammer unit 10 and a number of tubes 7 of which one is shown. Each tube is provided with an end piece 11. Shank adapter, tubes and drill bit are kept together by means of threaded connections 12. A number of rods 18 are arranged in the tube string 4 to rest loosely against each other. The rods are provided with not shown projections which cooperate with diameter reductions in tubes and end pieces so that the different tubes can be transported without the rods falling out of the tubes. The rods 18 transfer the impact energy of the first hammer piston 5 to the drill bit 8. The backhammer unit 10 comprises a housing 13 on which a housing part 19 is secured by means of a threaded connection 20. Housing 13 is connected with tube string 4 by means of a threaded connection 12. A second hammer piston 9 is movable to-and-fro between housing part 19 and cylinder 21. The second hammer piston is meant for impacting housing part 19 in a direction away from the drill bit 8. Impact energy is transferred from housing part 19 via threaded connection 20 to housing 13 and from there to tube string 4 and drill bit 8 in order to free the drill bit at jamming. A sleeve 22 is by means of a threaded connection 23 secured to housing part 19. A tube part 14 is loaded by a spring 15 to rest against housing 13. Tube string 4 is rotated by tube part 14 splined connection 24, sleeve 22, thread 23, housing part 19, thread 20 and housing 13. Tube part 14 is provided with a number of channels 25 for supply of working medium either for flushing the drill hole or for driving the second hammer piston 9. For controlling this, tube part 14 and housing 13 form two valves 16 and 17. The first valve 16 controls the supply of driving medium for driving the second hammer piston 9 via channels 26 in housing part 19. The return flow of the driving medium is conducted via channels 27 in cylinder 21 to a room 28 between the cylinder 21 and a protective cylinder 29. Room 28 is in connection with the surroundings via channels 30. Valves 16 and 17 are shown in the upper half of FIG. 2 in those positions which they take during drilling. When the rock drilling machine 2 is fed backwards along feed beam 1 with a force which exceeds a predetermined value, defined by spring 15, valves 16 and 17 take those positions which are shown in the lower part of FIG. 2. Through this automatic starting of the second hammer piston 9 is obtained so that the drill bit is freed at jamming.

We claim:

1. Rock drilling device comprising a rock drilling machine (2) arranged on a feed beam (1), a tube string (4) connected to the rock drilling machine for rotation of a drill bit (8) arranged at a front end of the tube string, a first hammer piston (5) for impacting said drill bit and a feeding device (6) for feeding said rock drilling machine to-and-fro along the feed beam, characterized in that the rock drilling device comprises a backhammer unit (10) having a housing (13) in which a second hammer piston (9) is movable to-and-fro, said backhammer unit further comprising a first valve (16) for automatically supplying driving medium to said second hammer piston when the rock drilling machine (2) is fed backwards along the feed beam (1) with a force which exceeds a predetermined value, whereby said tube string (4) is exposed to impacts in a direction away from the drill bit (8).

2. Rock drilling device according to claim 1, characterized in that said housing (13) is connected to said tube string (4), that a tube part (14) is connected to said rock drilling machine (2) and that a spring (15) is arranged for pressing said tube part against said housing to form said first valve (16).

3. Rock drilling device according to claim 2, characterized in that said tube part (14) and said housing (13) between each other form a second valve (17) for passage of flushing medium during drilling, which second valve closes said flushing medium passage when said first valve (16) opens.

* * * * *